US007327963B2

(12) United States Patent
Funabiki

(10) Patent No.: US 7,327,963 B2
(45) Date of Patent: Feb. 5, 2008

(54) IMAGE FORMING APPARATUS FOR DETERMINING AND CORRECTING MAGNIFICATION AND LOCATION OF IMAGE FORMATION

(75) Inventor: Hiroshi Funabiki, Uenohara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 242 days.

(21) Appl. No.: 11/077,036

(22) Filed: Mar. 11, 2005

(65) Prior Publication Data

US 2005/0207762 A1 Sep. 22, 2005

(30) Foreign Application Priority Data

Mar. 17, 2004 (JP) ..... 2004-075800

(51) Int. Cl.
*G03G 15/00* (2006.01)

(52) U.S. Cl. ..... 399/15

(58) Field of Classification Search ..... 399/9, 399/15, 26, 31, 49, 72, 160, 397, 401
See application file for complete search history.

(56) References Cited

U.S. PATENT DOCUMENTS 5,887,223 A * 3/1999 Sakai et al. ..... 399/60
6,377,758 B1 * 4/2002 OuYang et al. ..... 399/15
6,898,381 B2 * 5/2005 Maebashi et al. ..... 399/15
6,961,526 B2 * 11/2005 Tezuka et al. ..... 399/15

* cited by examiner

*Primary Examiner*—Hoan Tran
(74) *Attorney, Agent, or Firm*—Finnegan, Henderson, Farabow, Garrett & Dunner, L.L.P.

(57) ABSTRACT

An image forming apparatus equipped with a fixing device that fixes an unfixed image formed on a transfer sheet thereto, the image forming apparatus having: an image forming device for forming the unfixed image on the basis of image data; and an image pattern sensor for detecting an image pattern on the transfer sheet which the image has been fixed. At least one of a magnification and a location of the unfixed image formation on the transfer sheet is determined on the basis of the image pattern detected by the image pattern sensor and the image data. A correction for image formation by the image forming device is carried out on the basis of the determination.

17 Claims, 5 Drawing Sheets

FIG. 2
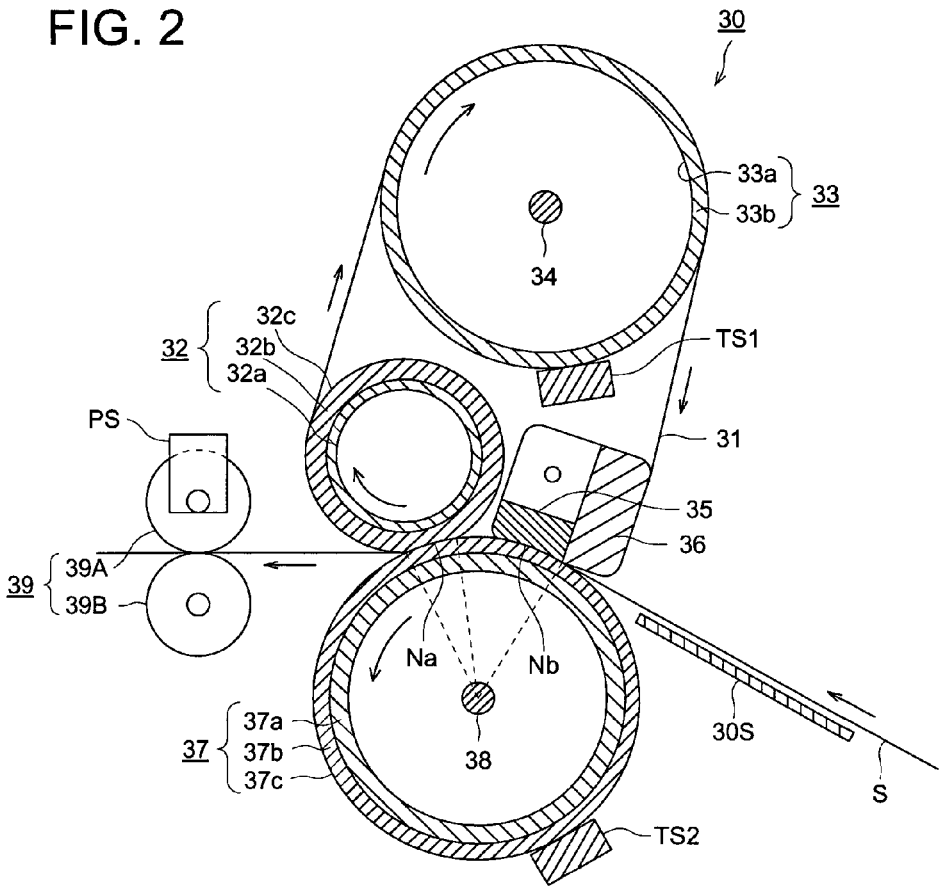
FIG. 3 ( a )
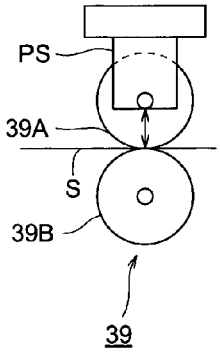
FIG. 3 ( b )
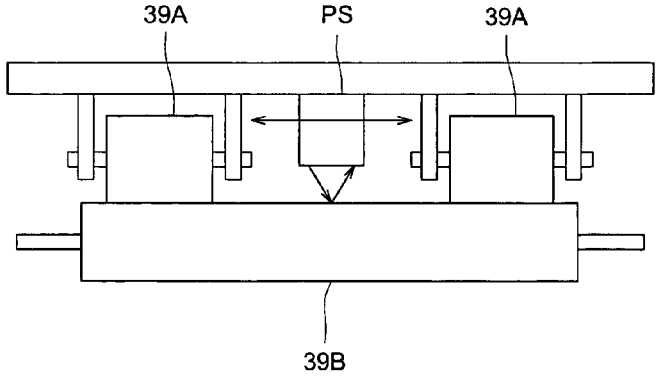

IMAGE FORMING APPARATUS FOR DETERMINING AND CORRECTING MAGNIFICATION AND LOCATION OF IMAGE FORMATION

BACKGROUND OF THE INVENTION

The invention relates to an image forming apparatus with a fixing device such as a copier, a printer, and a facsimile, for example, to an image forming apparatus that forms by electrophotographic method a toner image(s) on a single side or double sides of a transfer sheet and fixes the image(s) by a fixing device.

As a typical fixing device used for an electrophotographic method of image forming apparatus such as a copier, a printer and a facsimile, a heat roller fixing method has been frequently employed, which comprises a fixing roller with an elastic layer on it which is kept at a preset temperature and a pressing roller with an elastic layer on it which is pressure in contact with the fixing roller and works to heat a transfer sheet having a toner image on it while interposing and conveying the sheet.

Further, there has been a belt-type fixing device that uses an endless belt member (a fixing belt), which is supported by and entrained about a plurality of roller members.

However, when a toner image is heated and fixed by these fixing device, the moisture in the transfer sheet goes away into the air by heat during fixing and consequently, the transfer sheet shrinks. If the sheet shrinks too much, the image size becomes improper and may not meet users' requirements.

Further, due to specific deviations and changes with time of a feeder, the timing to feed sheets to the transfer section moves away from a designed timing value and, consequently, images will be positioned improperly on the sheets.

When forming an image on each side of a transfer sheet for double-side duplication, the transfer sheet subjected to transferring a toner image on one side thereof passes once through a fixing device for fixing the toner image, and then the transfer sheet subjected to transferring another toner image on the other side thereof passes again through the fixing device for fixing the another toner image.

When forming multiple duplication on a single side of transfer sheet to synthesize two images, the transfer sheet subjected to transferring a toner image on one side thereof passes once through a fixing device for fixing the toner image, and then the transfer sheet subjected to transferring another toner image on the same side thereof passes again through the fixing device for fixing the another toner image.

In these double-side duplication and multiple duplication, the first fixed transfer sheet is already shrunk by heat. Consequently, the first and second toner images become different in size and position thereof.

To solve such an image size problem, Patent Document 1 representing Japanese Non-examined Patent Publication H4-288560, for example, discloses a method of to measure the size of a transfer sheet before fixing and the size of the transfer sheet after fixing, to calculate a ratio of shrinkage of the transfer sheet from the result of measurement, and to control the optical system.

When making double-side duplication, the image forming apparatus disclosed by Patent Document 2 representing Japanese Non-examined Patent Publication H10-149057, measures the size of the first transfer sheet before fixing and the size of the transfer sheet after fixing by a sensor, calculates a ratio of shrinkage of the first transfer sheet from the result of measurement, and uses this ratio to correct image sizes for the second and later transfer sheets.

The image forming apparatus disclosed by Patent Document 3 representing Japanese Non-examined Patent Publication H10-319674, has a deviation detecting means that detects a test pattern that is formed on a preset position of a transfer sheet and measures the registration deviation and skew of the transfer sheet and corrects the position of an image to be formed on the other side of the sheet according to the result of the measurement.

The color image forming apparatus disclosed by Patent Document 4 representing Japanese Non-examined Patent Publication H10-319675, is equipped with a first paper size measuring section that measures the size of a transfer sheet before or while an image is formed on one side of the sheet and a second paper size measuring section that measures the size of the transfer sheet before or while an image is formed on the other side of the sheet, and uses the result of these measurements to control the position and length of-the image to be transferred to the transfer sheet.

The image forming apparatus having a Double-Side Copy mode disclosed by Patent Document 5 representing Japanese Non-examined Patent Publication 2002-258680, measures the longitudinal and lateral sizes of a transfer sheet before and after fixing by a measuring means, calculates the ratio of shrinkage of the transfer sheet by the fixing device, and forms a toner image of a magnification corrected by this shrinkage ratio on the photosensitive drum. When making double-side duplication, the image forming apparatus uses the first transfer sheet for calculation of this shrinkage ratio, forms a toner image for one side of the second transfer sheet on the surface of the photosensitive material by a normal image formation method, and forms a toner image for the other side of the second transfer sheet at a magnification equivalent to the shrinkage ratio on the surface of the photosensitive material.

As disclosed by Patent Documents 1 to 5, to correct image location and magnification errors of images due to uneven conveyance of transfer sheets or shrinkage of transfer sheets by fixing, the conventional image forming apparatus has employed a method of forming a test pattern in initial fixing or a method of detecting the leading and trailing edges of a transfer sheet and correcting image location and magnification. The test pattern forming method requires extra transfer sheets and the sheet edge detecting method cannot correct image deviations on the transfer sheets.

SUMMARY OF THE INVENTION

The above problems can be solved by the following Item.

An image forming apparatus with a fixing device that fixes an unfixed image formed on a transfer sheet thereto, comprising an image forming means for forming the unfixed image according to image data and an image pattern detection sensor for detecting image patterns on the fixed transfer sheet, wherein at least one of image location and magnification of said unfixed image formed on the transfer sheet is determined according to the image data and the image pattern detected by the image pattern detecting sensor and a correction for image formation by the image forming device is carried out on the basis of the determination.

BRIEF DESCRIPTION OF THE DRAWINGS

FIG. 2 is a sectional view of the fixing device 30 of the invention.

FIG. 3(*a*) and FIG. 3(*b*) are-respectively front and side views of the paper ejecting section of the fixing device.

DETAILED DESCRIPTION OF THE PREFERRED EMBODIMENTS

Preferred embodiments of the present invention will be now detailed as follows. However, it is to be understood that the invention is not limited to these embodiments. The categorical explanation of the embodiments of the invention is for the best mode of the invention, but does not limit the meanings of terms and technical ranges of the invention.

<Image Forming Apparatus>

Figure 1:
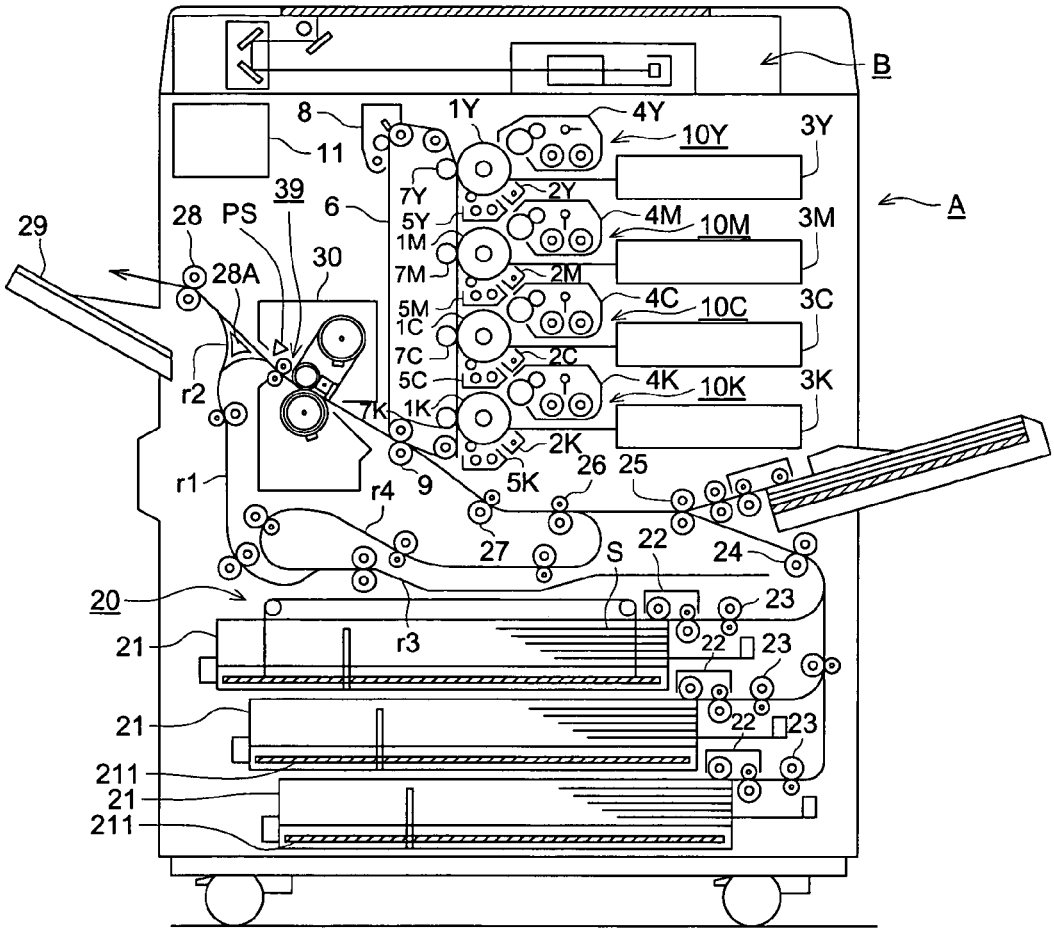
FIG. 1 is a schematic view of the image forming apparatus with a fixing device of the invention.

FIG. 1 is a schematic view of the image forming apparatus with a fixing device of the invention.

The image forming apparatus A is a tandem type color image forming apparatus comprising a plural sets of image forming means (10Y, 10M, 10C, and 10K), a belt-like intermediate transfer member 6, a paper feeder 20, and a fixing device 30.

The image forming apparatus A has an image reading device B on the top. A document placed on the document table of the image reading device B is scanned by light to read its image by the optical system of the document image scanning and exposing device. The line image sensor reads the reflected light, converts the light signal into an analog signal photo-electrically, and sends the analog signal to a data processor 11. The data processor 11 processes the signal by analog processing, A/D conversion, shading correction, image compression, and the like, and sends the processed signal to the exposing means (3Y, 3M, 3C, and 3K).

The yellow color (Y) image forming means 10Y is composed of a photosensitive drum 1Y as an image carrier, a charging means 2Y, an exposing means 3Y, a developing device 4Y, and a cleaning means 5Y that are provided around the drum 1Y. The magenta color (M) image forming means 10M is composed of a photosensitive drum 1M as an image carrier, a charging means 2M, an exposing means 3M, a developing device 4M, and a cleaning means 5M that are provided around the drum 1M. The cyan color (C) image forming means 10C is composed of a photosensitive drum 1C as an image carrier, a charging means 2C, an exposing means 3C, a developing device 4C, and a cleaning means 5C that are provided around the drum 1C. The black color (K) image forming means 10K is composed of a photosensitive drum 1K as an image carrier, a charging means 2K, an exposing means 3K, a developing device 4K, and a cleaning means 5K that are provided around the drum 1K. Each set of the charging and exposing means (2Y and 3Y, 2M and 3M, 2C and 3C, and 2K and 3K) builds up a latent image forming means Each of the developing devices (4Y, 4M, 4C, and 4K) contains a 2-component developing agent containing color toner particles (yellow, magenta, cyan, or black) of small particle sizes and a carrier.

The intermediate transfer member 6 is entrained about and supported rotatably by a plurality of rollers.

Color images respectively formed by the image forming means (10Y, 10M, 10C, and 10K) are transferred (primary image transfer) onto the moving intermediate transfer member 6 in sequence by the primary transferring means (7Y, 7M, 7C, and 7K) to form a single synthesized color-image.

A transfer sheet S is taken up from the inside of a transfer sheet storage (paper cassette) 21 of the paper feeder 20 by a paper feeding means (the first paper feeder) 22, conveyed to the secondary transferring means (transfer rollers) 9 by means of feed rollers 23, 24, 25, and 26 and the registration rollers (the second paper feeder) 27. Then, a color image is transferred (secondary image transfer) onto the transfer sheet S.

Three transfer sheet storages 21 are disposed vertically in the lower part of the image forming apparatus A. They are assigned an identical number 21, because they have similar configurations. Further, three stages of paper feeding means 22 are also assigned an identical number 22 because they have similar configurations. The transfer sheet storages. 21 and the paper feeding means 22 constitute a paper feeding device 20.

The fixing device holds the transfer sheet S having a color toner image on it, and applies heat and pressure to the transfer sheet S. With this, the color toner image (or toner image) is fixed to the transfer sheet S. The fixed sheet is interposed by the ejection rollers 28 and ejected onto the ejection tray 29 outside the apparatus.

After transferring the color image onto the transfer sheet S by the secondary transfer means 9, the intermediate transfer member 6 which has separated the transfer sheet by the curvature thereof is cleaned by the cleaning means 8 to remove the left-over toner from the intermediate transfer member 6.

To reverse and eject a fixed sheet, a reversing plate 28A is provided between the fixing device 30 and the ejection rollers 28. A transfer sheet S coming from the right side of the reversing plate 28A is turned down into the paper path r1, then moved up to pass by the left side of the reversing plate 28A, delivered into the paper path r2 (in the left side of the reversing plate 28A), and ejected by the ejection rollers 28 to the outside of the image forming apparatus.

When forming images on both sides of a transfer sheet S, the transfer sheet S having a fixed image: on the first side is fed to the paper path r1 and then to paper path r3, fed back into the paper path r4, fed upward, and delivered toward the image forming means 10 by the rollers 26. A color image formed by the image forming means (10Y, 10M, 10C, and 10K) is transferred to the second side of the transfer sheet, heat-fixed by the fixing device 30, and ejected to the outside by the ejection rollers 28.

Although the above description assumes that the image forming apparatus A forms a color image, the invention is also applicable to formation of monochromatic images.

<Fixing Device>

FIG. 2 is a sectional view of the fixing device of the invention.

The fixing device 30 of the invention is composed of a heating means made up with a supporting and pressing roller 32, a supporting and heating roller 33, a heating source 34, a pad 35, and a guide member 36 within the loop of a fixing belt 31 and an external pressing roller 37 outside the loop of the fixing belt 31.

The fixing belt 31 is an endless belt member which is entrained about each of the outer circumferential surfaces of the supporting and pressing roller 32, the supporting and heating roller 33, the heat source 34, the pad 35, and the guide member 36.

The supporting and pressing roller 32 is provided opposite the external pressing roller 37 to support the fixing belt 31 at part of the inner surface of the fixing belt 31. The supporting and heating roller 33 having a heat source 34 therein is provided to support the fixing belt 31 at part of the inner surface of the fixing belt 31.

The external pressing roller 37 having a heat source 38 therein is provided to press the fixing belt 31 and the transfer sheet S together against the supporting and pressing roller 32 and the pad 35.

The heat sources 34 and 38 can be radiant heat sources such as halogen lamps, carbon heaters, and xenon lamps, but can be any electromagnetic induction type heat source if an appropriate roller core is selected. Further, each heating roller can contain a plurality of heaters to give different amounts of heat.

A fixing nip section Na is formed at a place where the supporting and pressing roller 32 and the external pressing roller 37 are pressing against each other while interposing the fixing belt 31 that is heated by the supporting and heating roller 33. In the upstream side of the conveyance direction of the transfer sheet of the fixing nip section Na, an auxiliary nip section Nb acting upon the external pressing roller 37 is formed between the fixing belt 31 and the external pressing roller 37.

The fixing device 30 uses the auxiliary nip section Nb and the fixing nip section Na to fix a monochromatic or multi-color toner image on a transfer sheet by applying heat and pressure. Further, a pad 35 provided opposite to the external pressing roller 37 and a guide member 36 about which the fixing belt 31 is entrained, are provided inside the loop of the fixing belt 31.

The substrate of the fixing belt 31 is an electrocast nickel belt of 20 to 80 μm thick and 60 to 150 mm in inner diameter or a heat-resistant plastic belt such as polyimide of 50 to 200 μm thick. Its outer surface (circumferential surface) is coated with a silicone rubber layer of 100 to 500 μm thick. The silicone rubber layer is coated with a releasing layer of PFA (perfluoroalkoxy) or PTFE (polytetrafluroethylene) of 30 to 50 μm thick or covered with a PFA tube or film.

The supporting and pressing roller 32 is composed of a cylindrical metallic pipe 32*a*, for example, a SC steel (STKM) pipe of 2 to 5 mm thick, a silicone rubber layer 32*b* of 0.5 to 5 mm thick which covers the outer surface of the metallic pipe 32*a*, and a PFA tube 32*c* of 30 to 70 μm thick which covers the outer surface of the silicone rubber layer 32*b*. Substantially, this is a soft roller of 20 to 50 mm in outer diameter. Silicone sponge or the like can be substituted for the silicone rubber layer 32*b*.

The external-pressing roller 37 is composed of a cylindrical metallic pipe 37*a*, for example, a SC steel (STKM) or aluminum alloy pipe of 2 to 5 mm thick, a silicone rubber layer 37*b* of 1 to 3 mm thick which covers the outer surface of the, metallic pipe 37*a*, and a releasing layer 37*c* of a PFA tube of 20 to 50 μm thick which covers the outer surface of the silicone rubber layer 37*b*. Substantially, this is a soft roller of 40 to 80 mm in outer diameter.

A heat source 38 is provided in the external pressing roller 37 to heat the roller 37. A temperature sensor TS2 is provided todetect and control the surface temperature of the external pressing roller 37 at a preset temperature.

The supporting and heating roller 33 is composed of an aluminum alloy pipe 33*a* of 1 to 2 mm thick as a substrate, and a coating PFA layer of 10 to 30 μm thick which covers the outer surface of the pipe 33*a*. Substantially, this is a roller of 40 to 80 mm in outer diameter.

A heat source 34 is provided in the supporting and heating roller 33 to heat the roller 33. A temperature sensor TS1 is provided to detect and control the surface temperature of the supporting and heating roller 33 at a preset temperature.

A driving means (not shown in the drawing) drives the supporting and pressing roller 32 to rotate. The supporting and pressing roller 32 in contact with the fixing belt 31 also causes the fixing belt 31 to rotate. It is also possible to drive and rotate the external pressing roller 37 by the driving means and cause the roller 37 to rotate the fixing belt 31 as the external pressing roller 37 rotates. Further, it is possible to drive both the supporting and pressing roller 32 and the external pressing roller 37.

A monochromatic or multi-color toner image on a transfer sheet fed into the fixing area through the guide plate 30S is heat-pressed to fix by the auxiliary nip section Nb formed by the fixing belt 31, the external pressing roller 37, and the pad 35, and the fixing nip section Na formed by the supporting and pressing roller 32 and the external pressing roller 37.

Thanks to the flexibility of the fixing belt 31, the auxiliary nip section Nb is effective to assure a great heating time by a small diameter of the supporting and pressing roller 32.

<Writing-Control of the Image Forming Apparatus>

Figure 4:
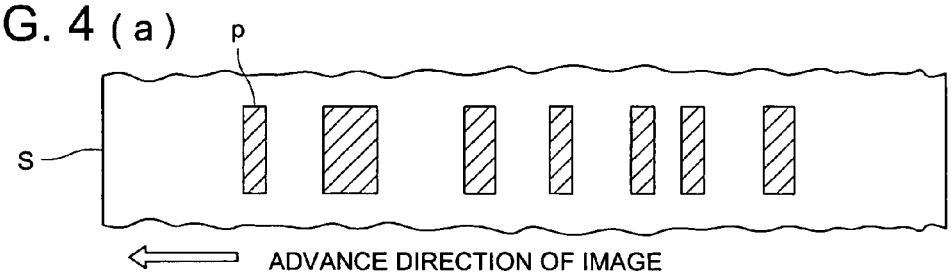
FIG. 4(*a*) through FIG. 4(*e*) are respectively a test image pattern formed on transfer sheets and examples of sensor outputs corresponding to the test image pattern.
Figure 4:
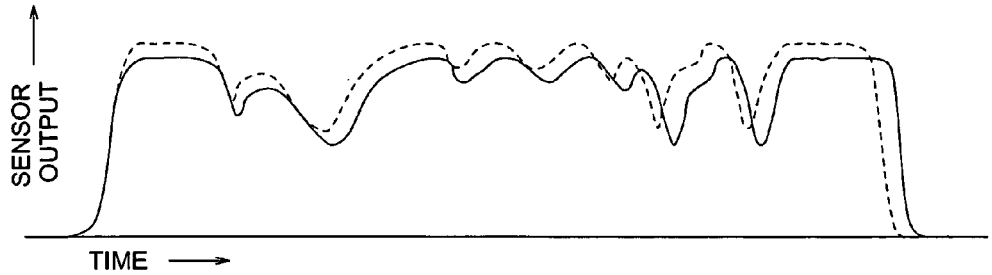
Figure 4:
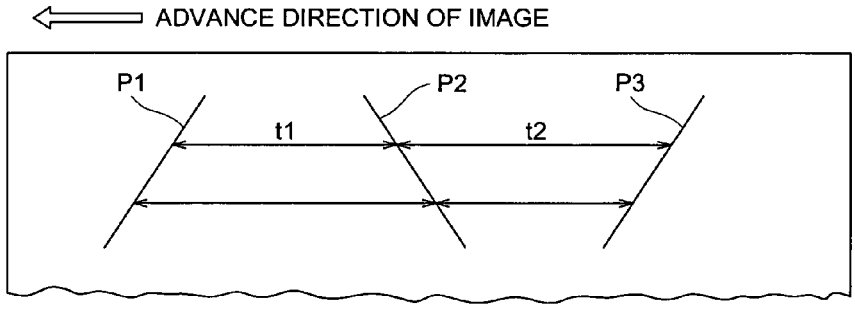
Figure 4:
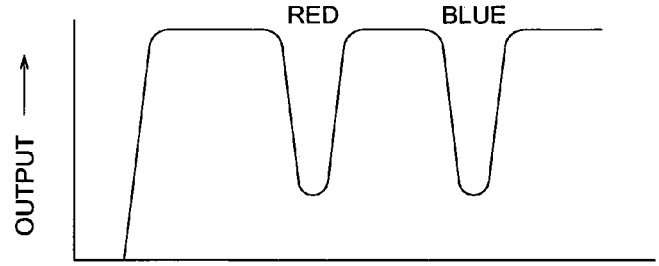
Figure 4:
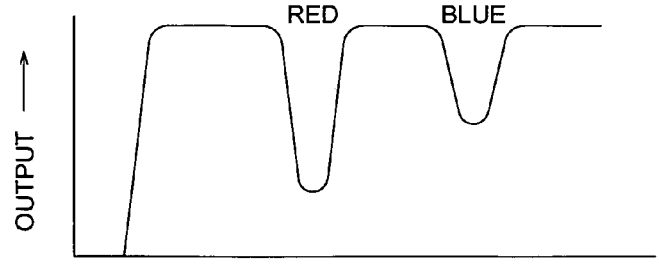
Figure 5:
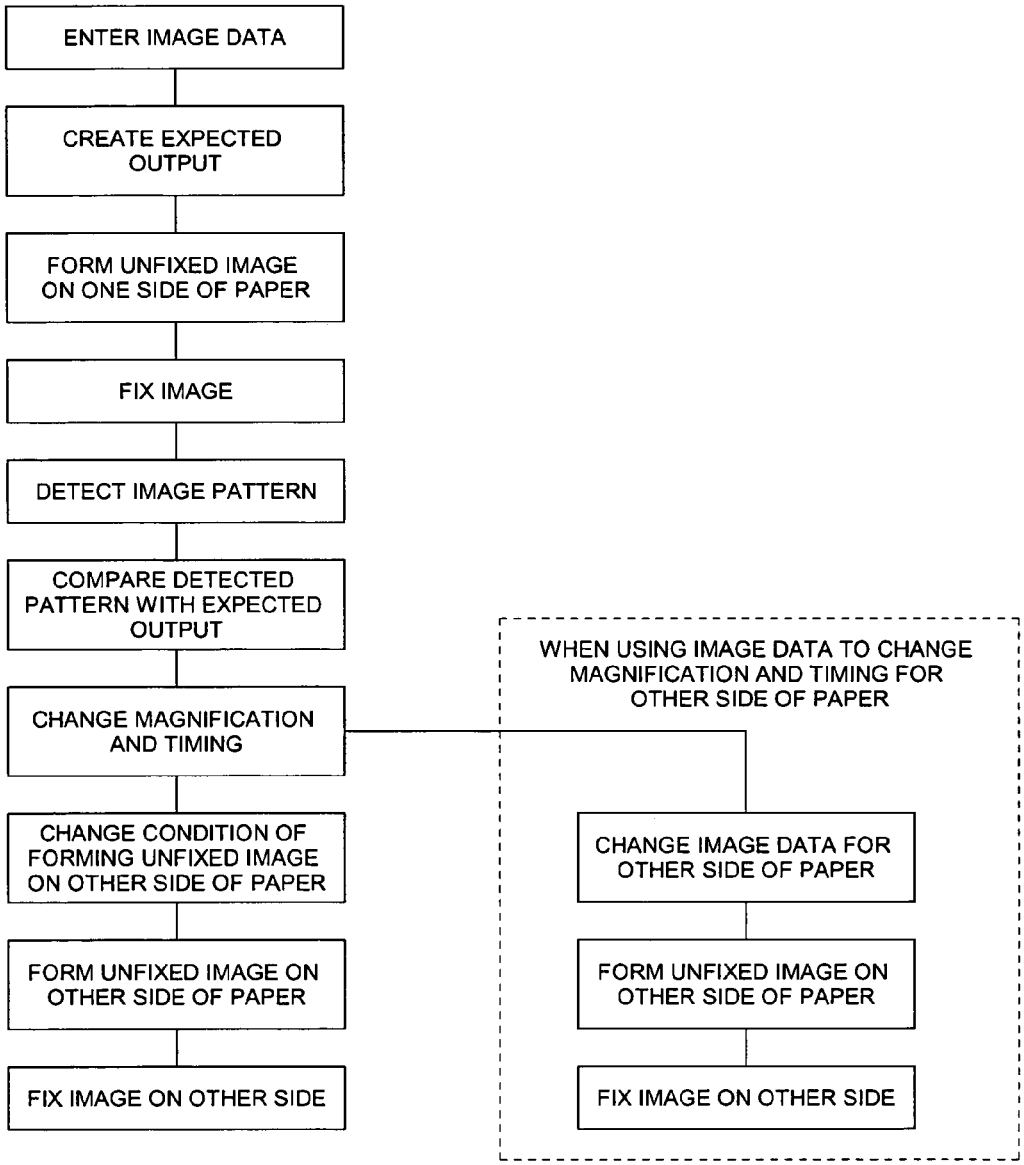
FIG. 5(*a*) and FIG. 5(*b*) are respectively a whole operational flow to control magnifications and positions (timing) on both sides of paper and an operational flow to change magnifications and positions (timing) on both sides of paper.
Figure 5:
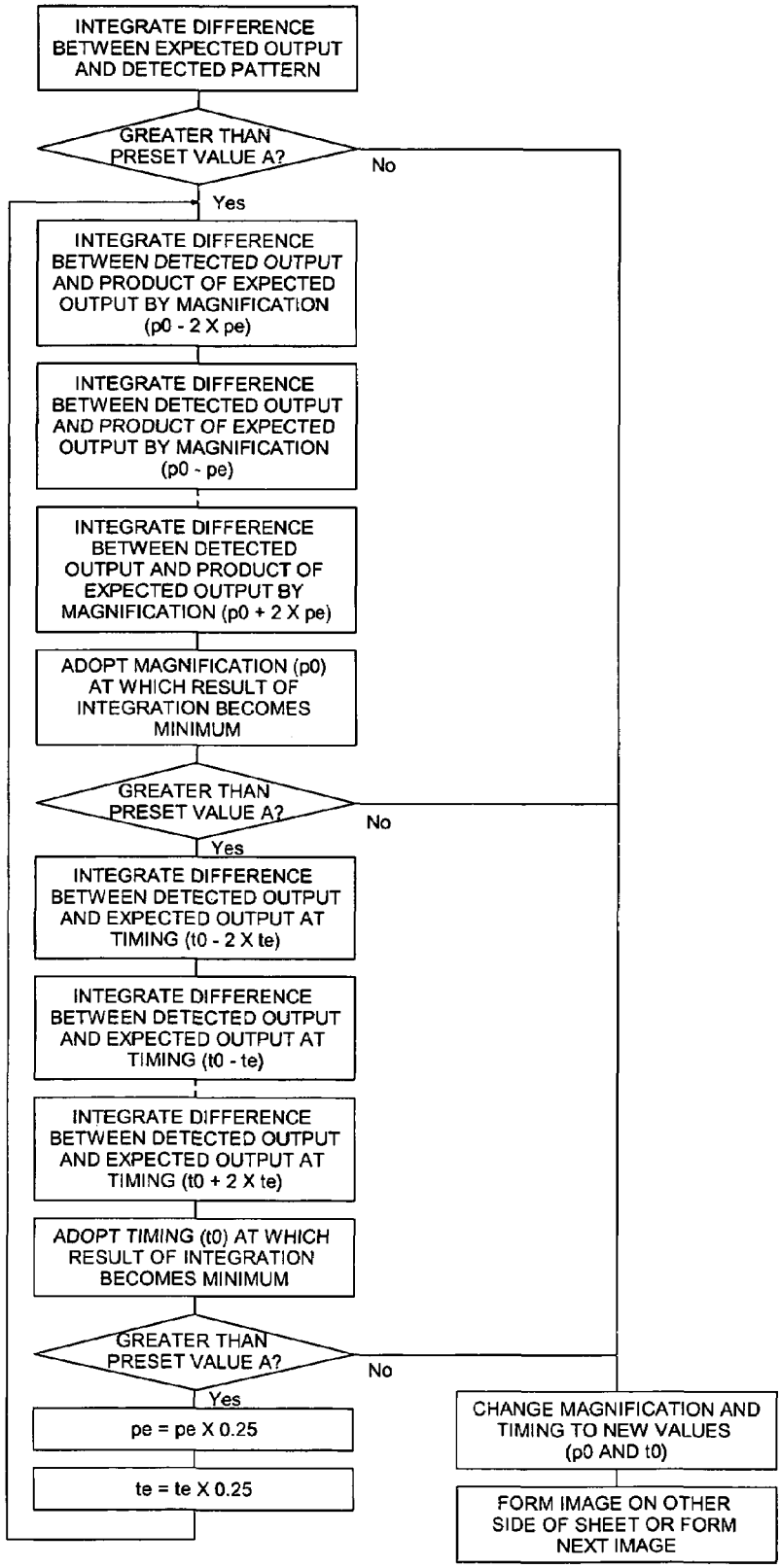

FIG. 3(*a*) and FIG. 3(*b*) are respectively front and side views of the paper ejecting section of the fixing device 30. FIG. 4(*a*) is a test image pattern formed on a transfer sheet. FIG. 4(*b*) is an output example of the sensor for the image pattern of FIG. 4(*a*). The white arrows in FIGS. 4(*a*) and 4(*c*) show the moving direction of an image. FIG. 5(*a*) shows the whole image formation control flow.

After being fixed by the fixing device 30, the transfer sheet S is ejected to the outside by the ejection roller pair 39 or fed back to the image formation path to have another image on the rear side of the sheet S. After the image on the sheet. S is fixed as shown in FIG. 5(*a*), the sensor PS provided opposite the nip area formed by an ejection roller pair 39 consisting of an upper roller 39A and a lower roller 39B output, as voltages, signals which change when the leading and trailing edges of the moving transfer sheet S are detected or when the actually-formed image pattern p is detected.

When the image forming apparatus is installed or maintained, the axial position of the sensor PS or position perpendicular to the movement of the transfer sheet is determined by outputting patterns to detect the position of the sensor PS, storing the results of detection, and comparing the results.

FIG. 4(*c*) shows an example of a pattern to catch the sensor position.

We can know the position of the sensor to a writing position, that is an image forming position, by the ratio of the time periods t1/t2, when forming lines P1, P2, and P3 on a transfer sheet, and detecting these lines P1, P2, and P3 by the sensor.

The ratio t1/t2 is constant at the axial positions of the sensors as long as the speeds of components of the image forming apparatus are constant not to say they are designed values. Therefore, we can uniquely determine the positional relationship between sensor positions and the unfixed image by measuring the t1/t2 value. If the t1/t2 value is 1, the sensor is in the center of this line pattern. If the t1/t2 value is greater than 1, the sensor is a little left from the center. See t1' and t2' in the drawing. This means to understand the relationship between the sensor position and the writing position is very effective when the sensor is move as explained below.

When obtaining an expected output by calculating this sensor sensitivity distribution relative to the image data, we also calculate sensitivities to colors together with the sensitivity distribution in the sensor measuring area (for color images).

FIG. 4(*d*) and FIG. 4(*e*) are characteristic diagrams of sensor outputs.

Referring to FIG. 4(*d*), if the sensor has uniform sensitivities over entire wavelengths, the sensor shows the same output levels for blue and red patterns. Generally however, the sensor has different sensitivities to wavelengths. For example, if the sensor has a high sensitivity to blue, the sensor shows a higher output for light from a blue pattern as shown in FIG. 4 (*e*). Therefore, when calculating an expected output, it is preferable to correct the output by the sensitivity of the color. In other words, if the sensor is higher sensitive to blue as shown in the example, we calculate an expected sensor output distribution from image data assuming that the sensor output from a blue pattern is higher and the sensor output from a red pattern is lower. It is preferable to correct the expected sensor minutely outputs by the other colors. Specifically, the image forming apparatus basically uses yellow, magenta, cyan, and black colors and outputs image data of each of these colors. Therefore, the expected sensor outputs should be corrected by the sensor sensitivities of these colors.

The writing-data processing section 11 of the image forming apparatus A creates an expected image pattern detection output and expected leading- and trailing-edge detection outputs by multiplying the image data corresponding to the sensor position by the sensitivity distribution of the sensor PS, compares the actual detection outputs by the above expected detection outputs in a virtual space built on memory of the control section, and determines a correction magnification and a writing-start timing correction value. (See FIG. 5(*a*) "Comparison between detection pattern and expected output.")

For convenience, the output of the sensor PS will be explained using an output of a simple image pattern shown in FIG. 4(*a*). When detecting an image pattern of FIG. 4(*a*), the sensor ideally outputs a rectangular waveform corresponding to image densities. However, when the sensor PS is a cheap element such as a photo sensor; the output is dull according to the space sensitivity distribution. FIG. 4(*b*) schematically shows the space sensitivity distribution of the sensor PS. The solid curved line in FIG. 4(*b*) shows the output of the sensor PS which is the output of the image pattern of FIG. 4(*a*).

When the photosensitive material speed, writing speed, intermediate transfer member speed, sheet speed, and respective kinds of timing are as designed, the output of the sensor output matches the solid line of FIG. 4 (*b*). However, the sensor output goes off the solid line because respective image forming apparatus has a manufacturing tolerance and the speeds of the apparatus components are not equal to what are designed. For example, the broken line in the figure shows the output of the sensor when the intermediate transfer member speed if a little slower than designed although the other speeds and timing values are fully equal to what are designed. If the intermediate transfer member speed is slower even when an image is formed as designed on the photosensitive material, the image transferred onto the intermediate transfer member is a little shrunk along the movement of the sheet. In designing, the paper feeder is made to feed paper a little faster than the intermediate transfer member and the transfer section feeds paper a little faster than the fixing device so that a paper sheet may sag between the above units. Therefore, the reduced image on the intermediate transfer member is directly formed on the paper sheet. Contrarily, for example if the paper feeder feeds paper a little slower than the intermediate transfer member, the image may be prolonged on the transfer section.

Various algorithms can be used to correct a writing magnification and a writing timing. This embodiment determines a distance of the transfer sheet S from the reference position and a magnification for correction by moving the detection output relative to the expected output within a preset value, selecting a distance to minimize the difference, moving the detection output relative to the center of the image area by within a preset value, selecting the magnification to minimize the difference, and repeating these steps.

In other words, this embodiment selects an image location and a magnification to match the solid line with the broken line in FIG. 4(*b*) in a virtual space built on memory of the control section. FIG. 5(*b*) shows an algorithm to match the solid and broken lines. In FIG. 5(*b*), this algorithm normalizes the detected broken line data and the solid line data which is created from image data and the sensor sensitivity distribution (by multiplying a constant to make their integration values equal in the whole length), moving the origin of the time base (equivalent to the movement of the paper) of the measured data so that the integration value of the difference between the broken line data and the solid line data in the whole length may be smallest, and changing the magnification of the time base. In other words, this algorithm finds a position at which the integration of the difference between the expected data and the detected data becomes smallest by moving the origin by a preset offset (distance) from the expected position and changing the magnification which the integration of the difference between the expected data and the detected data becomes smallest by the preset offset. Next, this algorithm multiplies the data by the magnification, moves the magnification by a smaller offset than the previous value, and finds a position at which the integration of the difference between the expected data and the detected data becomes smallest.

Although this embodiment implements a magnification adjustment after a position (timing) adjustment, this can be changed according to the image forming apparatus to be adjusted. Particularly, it is preferable to first implement magnification adjustment or timing adjustment whichever becomes more affected in the default status (in terms of difference integration), that is, whichever has a greater reduction in the integration of the difference in the first adjustment.

The origin (p0, t0), magnification offset range (a preset value A), offset step (pe, te), and the number of repetitions are determined by the required performance, variation in paper feed timing, and magnitude of paper shrinkage and expansion. For example, if the paper feed timing may vary ±10 mm at a certain point, the control section moves the position (timing) at a step of 2 mm in the range of ±12 mm, corrects the magnification at a step of 1% in the range of ±5%, moves the position (timing) at a step of 0.5 mm in the range of ±4 mm, looks for a position at which the integration of the difference between the expected data and the detected data becomes smallest, corrects the magnification at a step of 0.2% in the range of ±2%, and repeats the position correction and the magnification correction at a smaller step by a preset number of times. As for the number of repetitions, it is possible to repeat the corrections until the integration of the data difference in the whole length goes below a preset value.

FIG. 5(*b*) shows a repetitive routine which determines a magnification value and a timing value. This routine moves the magnification value by −2, −1, 0, 1, and 2 times a magnification unit "pe" from the magnification center "p0" and the timing value by −2, −1, 0, 1, and 2 times a timing unit "te" from the timing center "t0," move the expected output with these offsets for correction, and integrates the differences between the expected and detected outputs. The origin (p0, t0) or magnification, each system selects the magnification/timing unit (pe, te), and the offset values by trial and error.

The preset value A means a tolerance of a positional or magnification offset and is unique to each image forming apparatus. This can be changed to user's demand and by the user.

By repeating three sets of position adjustment and magnification adjustment and using the obtained information for forming a next image, this embodiment can reduce the visible positional/magnification difference of images between front and back sides of the paper within 0.5 mm.

Basically, the transfer paper after fixing has the trailing edge easily curled because of the shape of the fixing nip and the thermal difference. Therefore, it is possible to greatly improve the accuracy of image pattern detection by detecting the actual image pattern which is formed and fixed on the transfer sheet.

Based on the above adjusting method, when printing an image on the other side of the transfer sheet, the image forming apparatus selects timing to start image formation and a magnification to positionally match images on both sides of the transfer sheet S and forms the image on the other side of the sheet.

When forming an image on the next sheet for the next print, the image forming apparatus sets a writing-start timing and a magnification so that the image is formed to be at a position and in a size, which are designated by the image data with respect to the leading and trailing edge timing of the detected transfer sheet S.

Timing is controlled. For example, when the image is too close to the leading edge of the transfer sheet, the writing-start timing is delayed or the paper feed timing is expedited. We can use any of the above similarly for position controlling, but it is easier to change the write starting timing which will not affect paper feed controlling.

When the image forming apparatus contains one or more transfer sheets S moving in the paper path between the fixing device and the next transferring or fixing device in image formation on the rear side of paper (or in the multiple duplication), the correction values for the front side of the transfer sheet are used also to form another image on the rear side of the sheet. However, it rarely happens that these values vary in continuous image formation. Therefore, the correction data for the first image formation can be used for succeeding image formations. If the fixer temperature greatly varies in the continuous image fixing operation, the correction should preferably be done on each print. If the print sheets S are changed in the continuous image formation, the correction should preferably be done each time when print sheets are changed.

It is possible to change the writing magnification by changing the image writing clock speed and the image processing speed, changing the speed of the optical scanning system, or changing the writing clocks. It is possible to change the writing clock by varying the magnification in the scanning direction, to change the image processing speed by varying the magnification in the subsidiary scanning direction, and to change the speed of the optical scanning system by varying the magnifications in both main and subsidiary scanning directions simultaneously. When the image processing speed or the optical scanning speed is changed, it takes a lot of time between a time instant at which the speed is changed and a time instant at which the new speed becomes stable. Therefore, when a shorter paper sheet is used for image formation, the next printing must be halted, which reduces the productivity of the image forming apparatus. Further, the above changes may reduce image qualities for some kinds of image data. In this case, it is possible to simply expand or shrink the source image data when moving it as shown by the broken line of FIG. 5(*a*). This can go without any mechanical switching such as a change of the image processing speed and the optical scanning speed. This will not reduce the productivity of the image forming apparatus even when shorter paper sheets are used.

As the image data is externally given, the sensor PS installed is not always in a position fit for the image pattern p.

The detection accuracy can be increased by detecting an image pattern (p) fit for detection of a position and a magnification of an output image and moving the position of the sensor PS in the writing data processor 11 of the image forming apparatus A. Various algorithms are available to detect the appropriate image pattern (p). This embodiment employs an algorithm of multiplying the sensitivity distribution of-the sensor PS by the image data along 2 mm-spaced lines that are parallel to the moving direction of the transfer sheet within the range that the sensor PS can move in a virtual space on memory of the control section, calculating the image density distribution, and determining a position at which the peaks that have 50% or higher output corresponding to an image having the maximum image density exist at an interval of over 80% in the conveying direction of the transfer sheet S. As explained below, the sensor PS is moved to the determined position by a known moving mechanism using a screw or a wire.

If all peaks of the output corresponding to an image having the maximum image density are less than 50% or if the distance is not sufficient, each of the threshold values are decreased for selection. If the peak values are too small (for example 30% or less) or their intervals are too short (for example 60% or less), the correction may fail and, in extreme cases, the image position and magnification may be deteriorated. In such a case, this correction is not implemented.

If the absolute value of the moving amount or magnification for correction is too great (for example, more than ±5 mm as the moving amount for correction, and more than ±2% as the magnification for correction), when a feed trouble occurs, or when the correction algorithm or sensor sensitivity fails, the image forming apparatus stops this correction assuming that the sensor is not fit for the image pattern p and outputs under the initial setting condition or the previous output condition. The limit values of the magnification and moving amount are determined judging from the actual variations in production (experimental values). This can prevent excessive corrections.

The pair of ejection rollers 39 is composed of a set of an upper rubber roller 39A and a lower plastic roller 39B. The sensor PS is provided opposite the upper rubber roller 39A that is in contact with the image side of the transfer sheet immediately after fixing.

The sensor PS detects the quantity of light reflected on the transfer sheet S or the lower roller 39B and outputs a corresponding voltage. For assurance of effective detection of the leading and trailing edges of a general white transfer sheet S, the lower roller opposite the sensor PS is black or deep colored. This decreases the sensor sensitivity to high-density colored paper, but almost all paper used by the image forming apparatus is white and this is very useful to the users.

The upper roller 39A is not in the detection position of the sensor PS. The sensor PS is so positioned to detect the position and the image pattern p of the transfer sheet at a place where the transfer sheet S is in securely contact with the lower roller 39B. Since the sensor is provided in such a place, the distance between the sensor and the paper is always constant. This enables high-precision and stable detection of image densities and paper edges.

It is preferable that the sensor PS can move all over the image width, but part of the area is enough to get a proper image pattern p at a high possibility or to increase the accuracy of detection. The sensor-supporting member is mounted on a screw shaft in parallel with the upper roller 39A so that it can move between both ends of the roller 39A. With this, the sensor PS moves to a position to detect the appropriate image pattern p that is selected by the algorithm for setting an image detection-position. These positions can be selected by various kinds of selection algorithms. However, this embodiment selects a position at which the height of the respective detected peaks (percentage to the maximum image density) by the peak-to-peak distance (percentage to the paper size along the movement of the paper) is the greatest. This sensor position is detected as the number of screw revolutions (not a rotational speed) by an encoder or the like for controlling.

Instead of moving a sensor PS, it is also possible to provide a plurality of sensors PS, a sensor located at the best position out of the plurality of sensors may be used to detect an image and a transfer sheet by estimating their outputs corresponding to each position. Sensors can be selected in the similar manner to that for the sensor movement. Also in this case, if the images for all of the sensors PS are assumed to be improper for correction of magnifications and locations (by the above algorithm), the image forming apparatus stops the correction.

If the positional deviation and the deviation in magnification of the first output among a series of image formation output instructions are respectively less than a tolerance (for example, ±1 mm and ±0.3%), the image forming apparatus keeps on outputting. If the positional or magnification deviation exceeds the tolerance in the first sheet fixing, the image forming apparatus makes a correction and outputs the first sheet again. In this case, the image forming apparatus informs the user of this re-outputting of the first sheet by indicators on the operation panel or the like of the image forming apparatus to prevent immigration of the same pages.

Similarly, the image forming apparatus keeps on outputting for the second sheet and thereafter as long as the deviation is within the preset value while correcting according to the result of measurement of the preceding output. As explained above, if paper sheets of the same kind are used continuously, the first measuring and correcting conditions can be applied to the succeeding outputs. If the user can select whether re-outputting is required (by the above preset value), high-quality printing or waste-less printing can be selected according to the user's demand.

The structures of the invention are particularly effective for a high speed image forming apparatus and a color image forming apparatus that are used in the publishing-on-demand (POD) market that requires a high precision level.

Before starting an actual image forming operation, the image forming apparatus determines the magnification and position of an image according to the pre-printing information (or printing on the front side of the transfer sheet when the rear side of the sheet is fixed) and forms an unfixed image on the sheet according to the information. In this case, the line speed is changed if necessary. Then the sheet having the unfixed toner image is conveyed to the fixing area through a guide or the like, heated and pressed while being interposed between the fixing belt 31 and the external pressing rollers 37, and heat-fixed the toner image thereon.

The invention can minimize the wasteful output (consumption of transfer sheets) and increase the image magnification and positional accuracies independently of paper types.

In the above description, this embodiment assumes a belt-type fixing-device. However, it is to be understood that the invention is also effective to a roller-type fixing device.

The features of the image forming apparatus of this embodiment are listed below.

(1) Using input image data, data obtained by detection of a fixed image pattern and data obtained by detection of the leading and trailing edges of the transfer sheet for correction.

(2) High detection accuracy of sensors to detect an image pattern and leading and trailing edges of transfer sheets because they are provided opposite to the ejection roller.

(3) Performing an operation corresponding to a sensor sensitivity distribution on input image data and setting a magnification and a quantity of positional correction to make the least data difference.

(4) Keeping on outputting when the positional variation is a preset value or less, correcting and outputting the first sheet again when the positional variation exceeds the preset value, keeping on outputting the second and succeeding sheets if the variation is a preset value or less while correcting according to the result of measurement in the previous output.

(5) Using, as the lateral position of the sensor, what is obtained by measuring the axial position of a test pattern when the apparatus is installed or maintained and stored as position data.

(6) Moving the sensor to a position fit for detection of a shrinkage ratio according to the image data or using the previous correction data if there is no image pattern in the sensor position.

As explained above, the image forming apparatus with a fixing device of the embodiment directly uses the fixed image data. Therefore, no extra sheet is required to handle the shrinkage of paper after fixing. This can minimize wasteful consumption (consumption of transfer sheets and toner) and increase the image positional accuracy and the image magnification accuracy.

That is, according to the embodiment, images with high magnification accuracy without wasting transfer sheets can be obtained.

According to the embodiment, sensor characteristics can be corrected and images with high magnification accuracy can be obtained.

According to the embodiment, images with high magnification accuracy without wasting transfer sheets and the like can be obtained.

According to the embodiment, excessive and wasteful corrections against disturbances can be prevented.

According to the embodiment, suppress excessive and wasteful corrections against disturbances on image positions and magnifications can be prevented.

According to the embodiment, excessive variations in image positions and magnifications of the first transfer sheet in a series of image outputs can be prevented.

According to the embodiment, when the transfer sheet type changes in a series of image outputs, an excessive variation in the image position of the first transfer sheet which may occur can be prevented.

According to the embodiment, stray of transfer sheets having unwanted and unacceptable image outputs can be prevented.

According to the embodiment, a reduction in the accuracy of detecting positions and magnifications due to uneven thickness of transfer sheets can be prevented.

According to the embodiment, a high accuracy of detecting leading and trailing edges of a normal white transfer sheets can be obtained.

According to the embodiment, a high accuracy of detecting image positions and magnifications can be obtained by selecting a proper sensor position.

According to the embodiment, a high accuracy of detecting image positions and magnifications of various image patterns can be obtained.

According to the embodiment, an optimum sensor position without any sensor moving mechanism can be selected.

What is claimed is:

1. An image forming apparatus equipped with a fixing device that fixes an unfixed image formed on a transfer sheet thereto, the image forming apparatus comprising:

(a) an image forming device for forming the unfixed image on the basis of input image data; and (b) an image pattern sensor for detecting an image pattern on the transfer sheet on which the image has been fixed, wherein at least one of a magnification and a location of the unfixed image formation on the transfer sheet is determined on the basis of the image pattern detected by the image pattern sensor and the input image data, and wherein a correction of at least one of a magnification and a location for image formation by the image forming device is carried out on the basis of the determination.

2. The image forming apparatus of claim 1, wherein the image forming device is capable of forming an image a plurality of times on the same transfer sheet.

3. The image forming apparatus of claim 2, wherein the image forming device is capable of forming an image on both sides of the transfer sheet, and the magnification or the location of the unfixed image is determined so that each of the image on a front and back sides of the transfer sheet is positionally matched each other.

4. The image forming apparatus of claim 2, wherein the image forming device is capable of multiple duplication.

5. The image forming apparatus of claim 1, wherein the image forming apparatus is capable of detecting a leading or trailing edge of the transfer sheet, the magnification or the location is determined according to a timing of the detected leading or trailing edge of the transfer sheet.

6. The image forming apparatus of claim 1, wherein the magnification or the location is determined so that the difference based an integration between the detected image pattern and the image data in the whole length may be smallest.

7. The image forming apparatus of claim 1, wherein the correction is carried out by changing an image forming condition.

8. The image forming apparatus of claim 1, wherein the correction is carried out by enlarging and reducing or moving an original image data.

9. The image forming apparatus of claim 1, wherein the magnification or the location of the unfixed image is determined by correcting the image data by an input sensitivity distribution of the image pattern sensor.

10. The image forming apparatus of claim 9, wherein the image data correction by the input sensitivity distribution of the image pattern sensor is carried out after the image data is multiplied by a sensitivity characteristic with respect to a wavelength of the image pattern sensor.

11. The image forming apparatus of claim 1, wherein a deviation of the magnification or the location of the unfixed image is a predetermined amount or more, the image data correction is stopped.

12. The image forming apparatus of claim 1, wherein a deviation of the magnification or the location of the unfixed image is a predetermined value or more, the image forming apparatus makes a correction and outputs the unfixed image again.

13. The image forming apparatus of claim 12, further comprising a notifying device to notify an operator that the output of the unfixed image has been carried again.

14. The image forming apparatus of claim 1, wherein the image pattern sensor is provided to face one of a pair of ejection rollers that are provided downstream of the fixing device along a conveyance direction of the transfer sheet.

15. The image forming apparatus of claim 1, wherein the image pattern sensor is movable in a direction perpendicular to a conveyance direction of the transfer sheet on the basis of the image data.

16. The image forming apparatus of claim 1, wherein a plurality of image pattern sensors are provided in a direction perpendicular to a conveyance direction the transfer sheet, and the image pattern is detected by any one of the sensors on the basis of the image data.

17. The image forming apparatus of claim 1, wherein the fixing device fixes the unfixed image formed by toner onto the transfer sheet by applying pressure or heat to the unfixed image.

* * * * *